US006470504B1

(12) United States Patent
Neuo

(10) Patent No.: US 6,470,504 B1
(45) Date of Patent: Oct. 29, 2002

(54) SPLASH PREVENTING URINAL

(76) Inventor: Rith Neuo, 17 Union Ave., Providence, RI (US) 02909

( * ) Notice: Subject to any disclaimer, the term of this patent is extended or adjusted under 35 U.S.C. 154(b) by 0 days.

(21) Appl. No.: 10/061,046

(22) Filed: Jan. 30, 2002

(51) Int. Cl.[7] ..... E03D 13/00
(52) U.S. Cl. ..... 4/310; 4/311; 4/301
(58) Field of Search ..... 4/301, 310, 311, 4/DIG. 5; D23/302, 307, 310

(56) References Cited

U.S. PATENT DOCUMENTS

| | | | | | |
|---|---|---|---|---|---|
| 1,022,147 | A | * | 4/1912 | Madden | 4/311 |
| 1,114,670 | A | * | 10/1914 | Baker | 4/310 |
| 1,379,206 | A | * | 5/1921 | O'Hara | 4/311 |
| 3,486,172 | A | | 12/1969 | Gleichert | |
| 3,914,803 | A | | 10/1975 | Gregovski | |
| D258,472 | S | | 3/1981 | Adam | |
| 4,348,776 | A | | 9/1982 | Sarjeant | |
| 4,612,676 | A | * | 9/1986 | Whitman | 4/301 |
| 4,709,426 | A | | 12/1987 | Godwin, Jr. | |
| D343,893 | S | * | 2/1994 | Roberts | |
| 5,287,563 | A | | 2/1994 | Peters | |
| 5,313,672 | A | | 5/1994 | Luedtke et al. | |
| 5,365,616 | A | | 11/1994 | Morad | |
| D377,972 | S | * | 2/1997 | Kanai | |
| 5,604,937 | A | | 2/1997 | Davenport | |
| D393,896 | S | | 4/1998 | Wagner et al. | |
| 5,815,851 | A | | 10/1998 | Perry | |
| D420,730 | S | * | 2/2000 | Thomas | |
| D424,183 | S | * | 5/2000 | Chiu | |
| D431,638 | S | * | 10/2000 | Chiu | |
| D458,669 | S | * | 6/2002 | Sanders | |

FOREIGN PATENT DOCUMENTS

| | | | | |
|---|---|---|---|---|
| DE | 199 27 160 A1 | * | 1/2001 | |
| GB | 20 694 | * | 10/1895 | 4/311 |
| GB | 321 053 | * | 10/1929 | 4/301 |
| GB | 1 046 978 | * | 10/1996 | 4/311 |
| GB | 766 | * | 10/1897 | 4/310 |

* cited by examiner

*Primary Examiner*—Charles R. Eloshway
(74) *Attorney, Agent, or Firm*—John D. Gugliotta

(57) ABSTRACT

A splash preventing urinal is provided having a pair of sidewalls extending vertically from the lower wall to the top wall and forming a combination sidewall and splash shield. The urinal extends outward from the rear wall from between 22 to 24 inches, and has an overall width of between 4 to 6 inches.

11 Claims, 2 Drawing Sheets

SPLASH PREVENTING URINAL

RELATED APPLICATIONS

The present invention was first described in Disclosure Document No. 463,256, filed on Oct. 7, 1999. There are no previously filed, nor currently any co-pending applications, anywhere in the world.

BACKGROUND OF THE INVENTION

1. Field of the Invention

The present invention relates generally to urinals and urinal splash guards and, more particularly, to uniquely designed splash minimizing urinal design.

2. Description of the Related Art

The battle to keep public restrooms clean and fresh smelling is an everlasting one. This is especially true in men's restrooms where urinals are present. Conventional urinals, with their small profile allow for the splashing of urine back at the user during use. This in turn causes the user to stand further away, thus causing the user to perhaps "miss" the urinal entirely. The next user, when faced with this mess stands even further back. It can be seen then, that this is an ever increasing problem that compounds itself during the use of conventional urinals. It is even worse in establishments that suffer from high, concentrated usage rates during a short period of time, such as schools, sport arenas, rest stops and the like, where it is impossible to clean them during the usage period.

Maintaining clean and sanitary toilet conditions becomes extremely difficult under these conditions. The wet floors also pose a liability hazard as well from possible slips and falls.

In the related art, numerous attempts have been made to aid in the foregoing problems. U.S. Pat. No. 5,815,851 issued in the name of Perry, U.S. Pat. No. 4,348,776 issued in the name of Sarjeant, and U.S. Pat. No. D 393,896 issued in the name of Wagner et al. disclose the design and function of a collapsible urinal and/or commode splash shield.

The following patents describe the design and function of a urinal screen assembly to help minimize splash back: U.S. Pat. No. 5,604,937 issued in the name of Davenport; and, U.S. Pat. No. D 258,472 issued in the name of Adam.

The following patents describe a toilet bowl splash deflector: U.S. Pat. No. 3,914,803 issued in the name of Gregorski; and U.S. Pat. No. 3,486,172 issued in the name of Gleichart.

U.S. Pat. No. 5,365,616 issued in the name of Morad discloses a non-splashing urinal deodorant block holder.

U.S. Pat. No. 5,313,672 issued in the name of Luedtke et al. discloses a urinal mat with upstanding baffles to decelerate a urine stream.

U.S. Pat. No. 5,287,563 issued in the name of Peters describes a hygienic urinal in which the bottom is recessed in the floor with included urine deflectors.

And, U.S. Pat. No. 4,709,426 issued in the name of Godwin et al. discloses a means for producing a water splash shield for urinals.

Accordingly, there exists a need for a means by which urine splashing can be reduced or eliminated while using a urinal.

SUMMARY OF THE INVENTION

Therefore, it is an object of the invention to indicate a device of the type disclosed above which avoids the disadvantages inherent in the state of the art. In particular, the device is to have wider sidewalls and a more concave frontal piece, as well as a narrow frontal profile, in combination with a mounting means disposing the device away from the wall.

It is therefore an object of the present invention to provide an improved urinal device.

It is another object of the present invention to provide an improved urinal device having wider sidewalls as well as a narrow frontal profile, disposing the device away from the wall.

It is a feature of the present invention to provide an improved urinal device that encourages the user to stand closer.

Briefly described according to one embodiment of the present invention, a splash preventing urinal is provided in which both the left and right sidewalls of the urinal are deeper and stand further away from the wall. The lower front portion is more concave and conforms more to the users body when compared to a conventional urinal. These two features allow for less splashing during use, thus allowing the user to stand closer to the urinal.

Advantages of the present invention are to reduce the mess around a typical urinal by reducing the splashing out onto the floor and by reducing the chance of the user missing the urinal entirely by allowing him to stand closer to it.

The use of the present invention allows for men's restrooms to be kept in a cleaner, more sanitary condition, without the requirement of frequent cleaning.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE DRAWINGS

Figure 1:
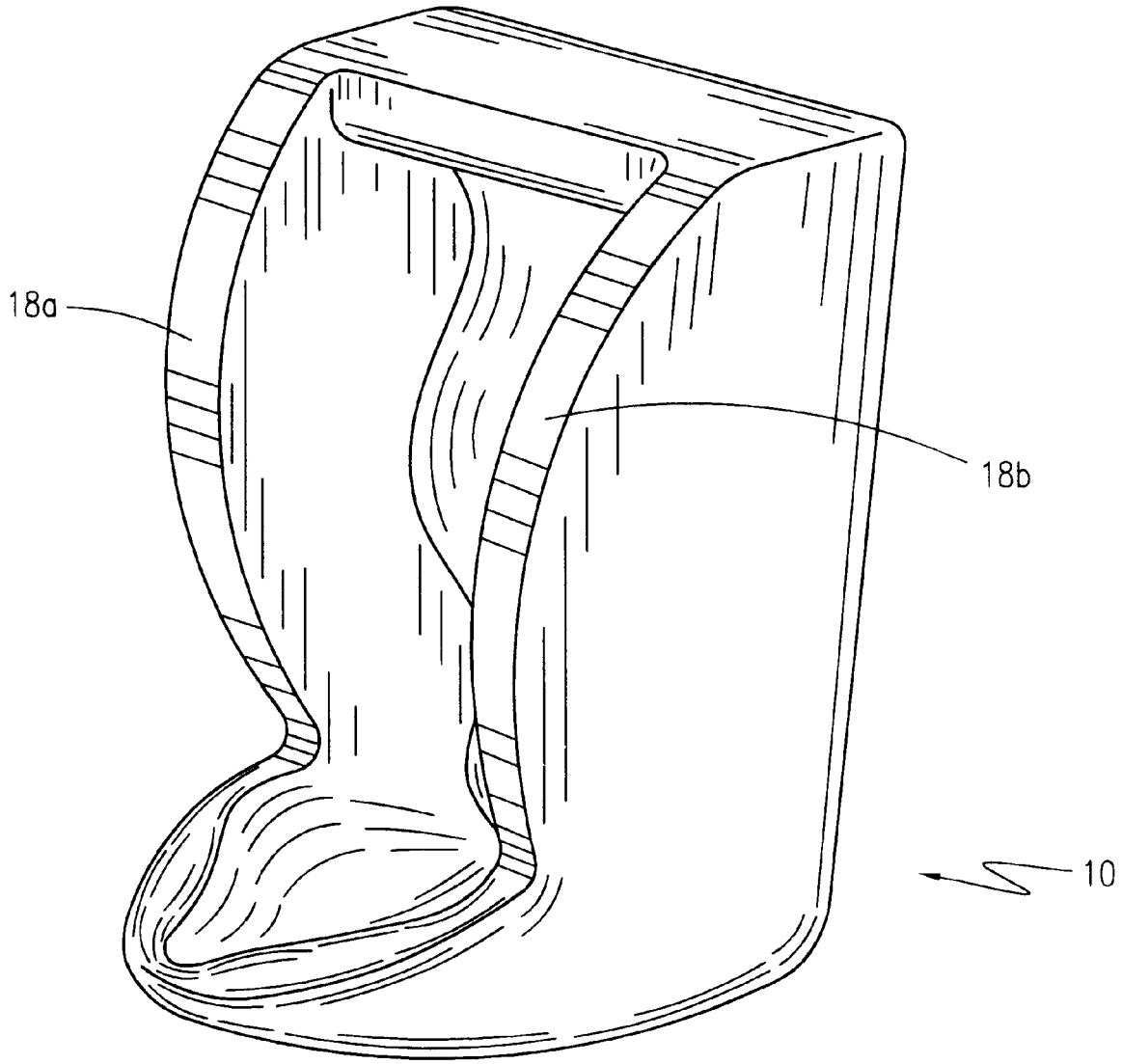
FIG. 1 is a perspective view of a splash preventing urinal according to the preferred embodiment of the present invention.
Figure 2:
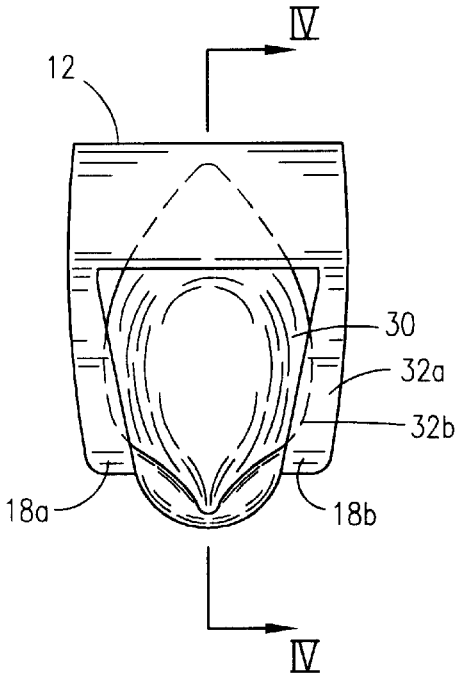
FIG. 2 is a top plan view thereof.
Figure 3:
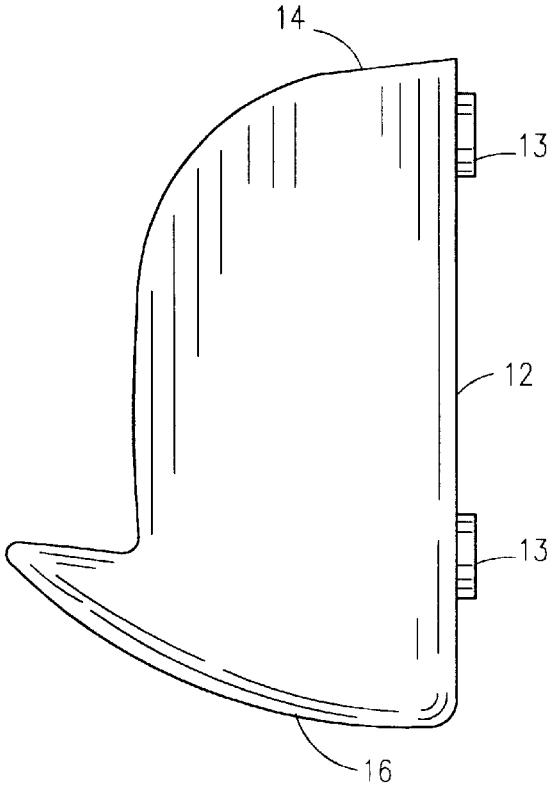
FIG. 3 is a side elevational view thereof, the opposite side being a mirror image.
Figure 4:
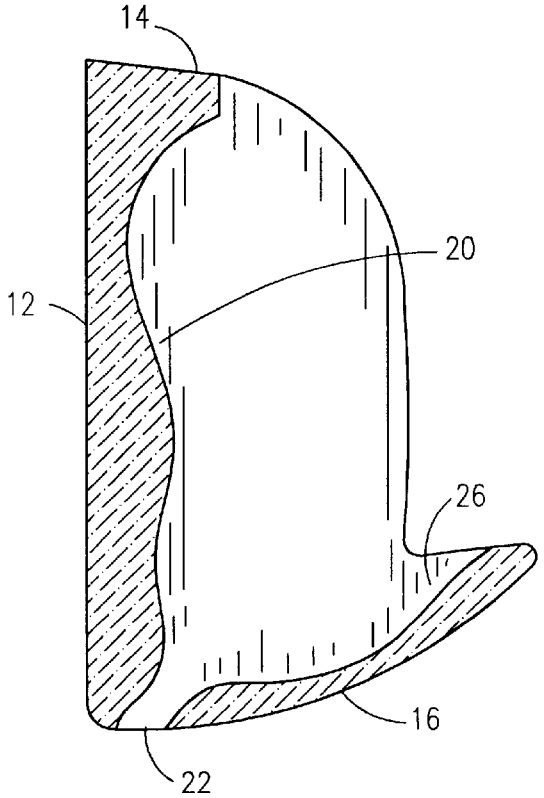
FIG. 4 is a side elevational cross sectional view taken along line IV—IV of FIG. 2.

Referring now to FIG. 1–4, a splash preventing urinal 10 is shown, according to the preferred embodiment of the present invention. Externally, the urinal 10 is defined by a vertical, flat rear wall 12, which is envisioned as being mounted adjacent to and flush with a vertical restrooms wall by a wall attachment means 13 of an otherwise conventional type. An outwardly protruding top wall 14 connected to the top edge of the rear wall 12 and extends horizontally outward from the rear wall 12. An outwardly, and upwardly protruding lower wall 16 is connected to the bottom edge of the rear wall 12 and extends horizontally outward from the rear wall 12. A first sidewall 18*a* and a second sidewall 18*b* both extend vertically from the lower wall 16 to the top wall 14. Each sidewall 18 forms a combination sidewall and splash shield, as will be described in greater detail below.

Internally, the inside surface of the rear wall 12 forms a curvilinear back plane 20 which forms a plurality of downward, backward sloping waves within the inside back panel. The back plane 20 is outward most toward the user at the upper top wall 14 and flows as a generally undulating surface downward toward a drain orifice 22. Such a surface configuration aids in allow for less splashing during use. The upwardly protruding lower wall 16 forms a concave lower surface 26 and conforms more to the users body. The concave lower surface 26 and flows downward along the lower surface 16 toward a drain orifice 22. Such a surface configuration aids in allow for less splashing during use. The first sidewall 18*a* forms a compound inner surface 30 having an acute outer plane 32*a* transitioning into an obtuse inner plane 32*b*. The outer plane 32*a* is a smooth surface directed away from the user and toward the rear wall 12. The inner plane 32*b* transitions gradually toward the back plane 20 and is a smooth surface directed toward the opposite sidewall 18. The second sidewall 18*b* similarly forms a compound inner surface 30 having an acute outer plane 32*a* transitioning into an obtuse inner plane 32*b*. The outer plane 32*a* is a smooth surface directed away from the user and toward the rear wall 12. The inner plane 32*b* transitions gradually toward the back plane 20 and is a smooth surface directed toward the opposite sidewall 18. Such surface configurations aid in allow for less splashing during use.

Generally, the overall surface configurations of the internal working surfaces of the urinal 10 aid in allowing for less splashing by directing any fluid streams inward, or toward other inside surfaces. This is one functional aspect of the present invention.

In combination with the disclosed surface configuration, another functional aspect of the present invention, in combination, results in allowing the user to stand closer to the urinal. To accomplish this, the overall physical dimensions of the urinal 10 allow the urinal 10 to conform more closely to the user's body. It is envisioned that each sidewall 18 in combination with the splash shield will extend outward from the rear wall 12 from between 18 to 20 inches, with the lower surface 16 extending outward from the rear wall 12 from between 22 to 24 inches. Further, the overall width of the urinal 10 and its associated rear wall 12 are envisioned as being between 4 to 6 inches only.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A splash preventing urinal comprising:

a vertical, flat rear wall adapted to be mounted adjacent to and flush with a vertical restrooms wall by wall attachment means, said rear wall forming an internal inside surface that forms a curvilinear back plane which forms a plurality of successive downward, backward sloping waves undulating downward toward a drain orifice;

an outwardly protruding top wall connected to a top edge of said rear wall and extends horizontally outward from said rear wall;

an outwardly, and upwardly protruding lower wall connected to a bottom edge of said rear wall and extending horizontally outward from said rear wall;

a first sidewall extending vertically from the lower wall to the top wall, said first sidewall forming a combination sidewall and splash shield; and a second sidewall extending vertically from the lower wall to the top wall, said second sidewall forming a combination sidewall and splash shield.

2. The splash preventing urinal of claim 1, wherein said upwardly protruding lower wall forms a concave lower surface.

3. The splash preventing urinal of claim 1, wherein said first sidewall forms a compound inner surface having an acute outer plane transitioning into an obtuse inner plane, said outer plane having a smooth surface directed away from the user and toward said rear wall, said inner plane transitioning gradually toward a back plane and is a smooth surface directed toward said second sidewall.

4. The splash preventing urinal of claim 3, wherein said second sidewall forms a compound inner surface having an acute outer plane transitioning into an obtuse inner plane, said outer plane having a smooth surface directed away from the user and toward said rear wall, said inner plane transitioning gradually toward a back plane and is a smooth surface directed toward said first sidewall.

5. The splash preventing urinal of claim 4, wherein the overall width of said urinal and its associated rear wall is between 4 to 6 inches.

6. The splash preventing urinal of claim 1, wherein said combination sidewall and splash shield extends outward from said rear wall from between 18 to 20 inches.

7. The splash preventing urinal of claim 6, wherein lower wall extends outward from said rear wall from between 22 to 24 inches.

8. The splash preventing urinal of claim 6, wherein the overall width of said urinal and its associated rear wall is between 4 to 6 inches.

9. The splash preventing urinal of claim 1, wherein lower well extends outward from said rear wall from between 22 to 24 inches.

10. The splash preventing urinal of claim 9, wherein the overall width of said urinal and its associated rear wall is between 4 to 6 inches.

11. The splash preventing urinal of claim 1, wherein the overall width of said urinal and its associated rear wall is between 4 to 6 inches.

* * * * *